US005304753A

United States Patent [19]

Parrish et al.

[11] Patent Number: 5,304,753

[45] Date of Patent: Apr. 19, 1994

[54] ELECTRIC SWITCH WITH WELDED CONTACT SENSOR LOCKOUT

[75] Inventors: Timothy L. Parrish, Kenly; Tony O. Woodard, Pine Level, both of N.C.

[73] Assignee: Eaton Corporation, Cleveland, Ohio

[21] Appl. No.: 84,385

[22] Filed: Jun. 29, 1993

[51] Int. Cl.[5] ..... H01H 15/06

[52] U.S. Cl. ..... 200/16 B; 200/DIG. 42

[58] Field of Search ..... 200/16 R, 16 B, 16 C, 200/16 D, 17 R, 18, 5 R, 440, 445, DIG. 42

[56] References Cited

U.S. PATENT DOCUMENTS

| | | | |
|---|---|---|---|
| 4,216,358 | 8/1980 | Brozille | 200/67 D |
| 4,616,117 | 10/1986 | Kleine | 200/243 |
| 4,645,886 | 2/1987 | Williams | 200/1 R |
| 4,647,727 | 3/1987 | Sontheimer | 200/1 R |

*Primary Examiner*—A. D. Pellinen
*Assistant Examiner*—Michael A. Friedhofer
*Attorney, Agent, or Firm*—L. G. Vande Zande

[57] ABSTRACT

A plunger operated switch has a pair of movable contacts on a movable contact carrier bridged by a secondary contact supported on a pushbutton operator member which is biased apart from the contact carrier. Depression of the pushbutton operator for the plunger assembly moves the primary movable contacts into bridging engagement with the stationary contacts through the secondary contact member. In the event the primary movable contacts weld to the stationary contacts and an operating force is removed from the plunger operator, a spring biases the secondary contact away from the primary movable contacts to open the bridging relationship therebetween and open the circuit controlled by the switch. A pair of normally closed contacts are arranged for operation by the pushbutton operator so that the contacts open before the main contacts close and close after the main contacts open, rendering them particularly suitable for use as dynamic braking contacts in a motor control application. Insulating means are provided between the primary movable contacts and the secondary bridging contact to prevent reclosure thereof once the secondary contact is separated from the primary movable contacts.

16 Claims, 4 Drawing Sheets

ELECTRIC SWITCH WITH WELDED CONTACT SENSOR LOCKOUT

BACKGROUND OF THE INVENTION

This invention relates to electric switches and in particular to electric switches which operate a secondary set of contacts in response to a welded condition of a primary set of contacts. Still more particularly, the invention relates to switches of the aforementioned type which are pushbutton operated, and to such switches which have an additional set of contacts particularly adapted for completing a dynamic braking circuit to a load controlled by the switch.

A welded contact in a switch maintains a current path through the switch after the switch has been operated to an off condition. This condition can be surprising to the user of apparatus controlled by the switch, and could be dangerous. If, for example, the switch controls a motor of an electric driven vehicle, a welded contact could cause the vehicle to continue to be propelled after the switch is operated to an off condition in expectation of stopping the vehicle.

U.S. Pat. No. 4,647,727 issued Mar. 3, 1987 to C. G. Sontheimer discloses a switch having normally closed auxiliary contacts operable to an open condition upon a welded condition of main switch contacts. The auxiliary contacts represent a separate complete switch within the switch housing having its own actuator and being operated by a specific condition of the linkage and operator of the main switch. The auxiliary switch also has its own terminals separate from the main contact terminals and therefore only provides safety in the system being controlled if the contacts are appropriately connected into the system.

U.S. Pat. No. 4,216,358 issued Aug. 5, 1980 to J. Brozille discloses a pushbutton snap switch wherein a pair of movable contacts oscillate between spaced pairs of stationary contacts by a snap action over-center mechanism. In the event the contacts remain welded upon depression of the pushbutton to drive the actuating mechanism over-center, continued depression of the pushbutton physically rotates the stationary contacts to break the circuit at a different location on the stationary contact. This weld-responsive action occurs on depression of the pushbutton which is normally associated with actuation of the switch, not release thereof. Release of the pushbutton permits the faulty contacts to be reclosed and the circuit to be re-energized.

SUMMARY OF THE INVENTION

This invention provides an electric switch having primary movable contacts engageable and disengageable with respective stationary contacts in response to depression and release of a spring biased plunger operator assembly. A secondary contact bridges the primary movable contacts to complete the circuit through the switch. The secondary contact is biased away from the primary movable contacts, but remain engaged therewith by a return spring acting on the plunger operator assembly and by an operating force applied to the plunger operator assembly. Removal of the operating force from the plunger operator assembly if the primary movable contacts become welded to the stationary contacts causes the biasing means to effect separation of the secondary bridging contact from the primary movable contacts, thereby opening the circuit. Insulator means are provided to prevent reclosure of the secondary contact to the main movable contacts after separation thereof has occurred. Alternatively, the secondary contacts are arranged to complete a circuit path through one primary stationary contact which includes a fuse link, such circuit path adapted for connection directly across an electrical power supply, whereby said fuse link will blow to open the circuit in the event the primary contacts weld. The invention, its advantages and features, will become more apparent when reading the following description and claims in conjunction with the accompanying drawings.

DETAILED DESCRIPTION OF THE PREFERRED EMBODIMENT

Figure 1:
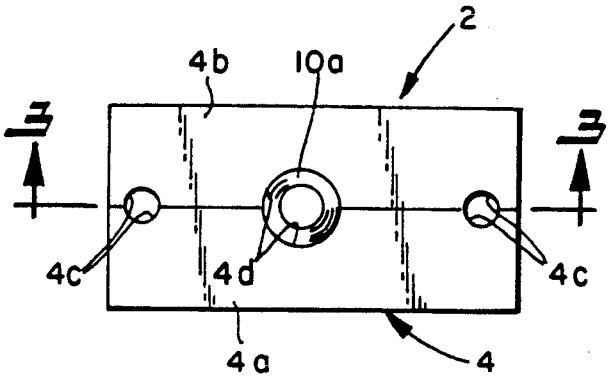
FIG. 1 is a top plan view of an electric switch constructed in accordance with this invention.
Figure 2:
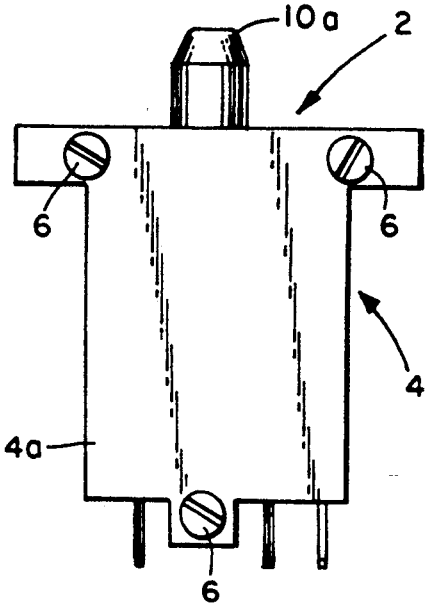
FIG. 2 is a side elevation view of the electric switch of FIG. 1.
Figure 3:
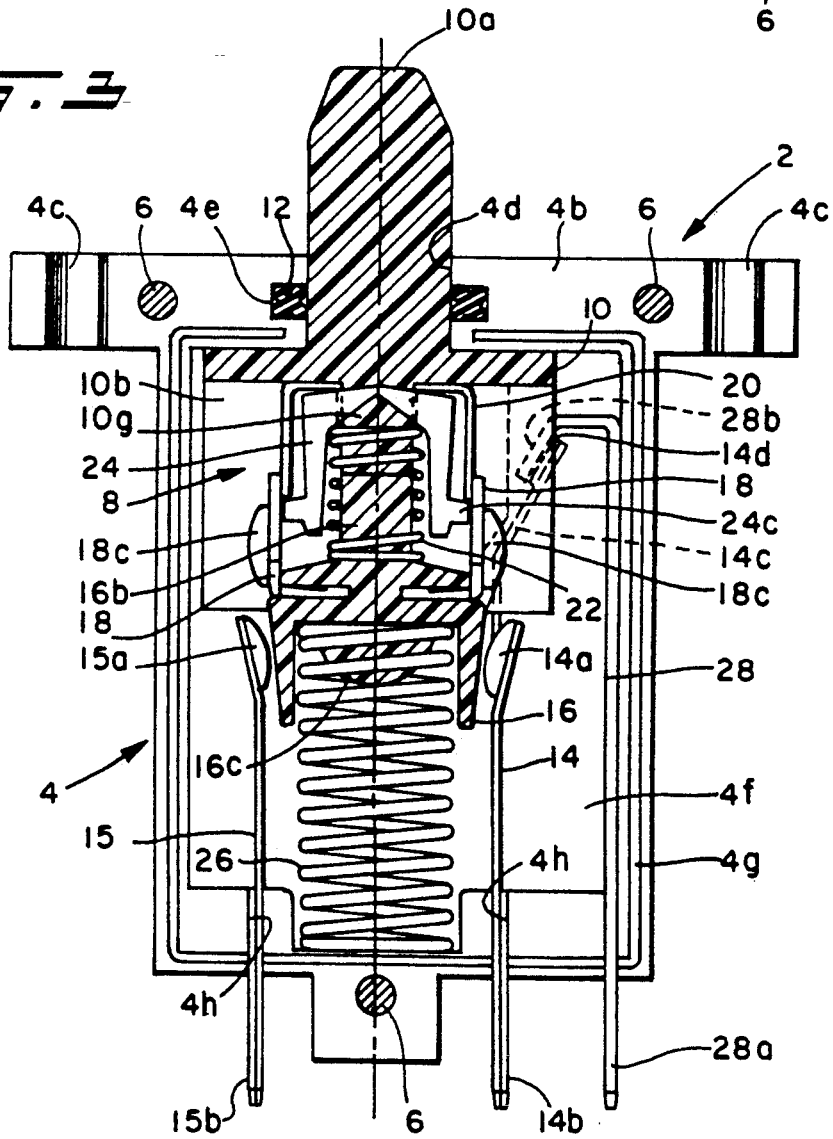
FIG. 3 is a cross sectional view taken generally along the line 3—3 in FIG. 1 of the electric switch of this invention, drawn to an enlarged scale.

An electric switch 2 constructed in accordance with this invention is shown in FIGS. 1–3. The switch 2 is a plunger or pushbutton operated switch having a molded insulating housing 4 comprising a pair of complementary molded shell halves 4*a* and 4*b* joined together by screws 6 received in clearance openings in shell half 4*a* and threadably engaging aligned openings in shall half 4*b*. The shell halves each have an upper mounting flange having semicylindrical recesses 4*c* formed in the respective mating surface which cooperate in assembly to provide mounting holes for switch 2. The upper mounting flange of each shell half also has a semicylindrical recess 4*d* which cooperate in assembly to provide a cylindrical opening through the housing for receiving the pushbutton operator 10 of a plunger operator assembly 8. A concentric groove 4*e* is provided in each respective semicylindrical recess 4*d* to receive an annular seal 12 (FIG. 3) which surrounds the pushbutton 10 to prevent the ingress of foreign particles and fluids into an interior chamber 4*f* of housing 4 provided by cooperating cavities in the respective housing shell halves. A groove 4*g* is provided in a mating face of housing shell half 4*b* as seen in FIG. 3, the groove extending along substantially the entire periphery of the housing. Although not shown, a complementary mating rib is provided on housing shell half 4*a* to be received in the grooves 4g to provide a tongue and groove seal between the two housing shell halves.

A pair of stationary contacts are mounted in switch housing 4. The stationary contacts comprise leaf spring contact blades 14 and 15 having their upper ends flared outwardly and receiving button contact elements 14a and 15a thereon. The lower ends of the respective contact blades 14 and 15 are folded over on themselves to provide a double thickness terminal portion 14b and 15b which is pressed into respective slots 4h in the lower wall of the housing formed by the respective shell halves 4a and 4b.

Figure 4:
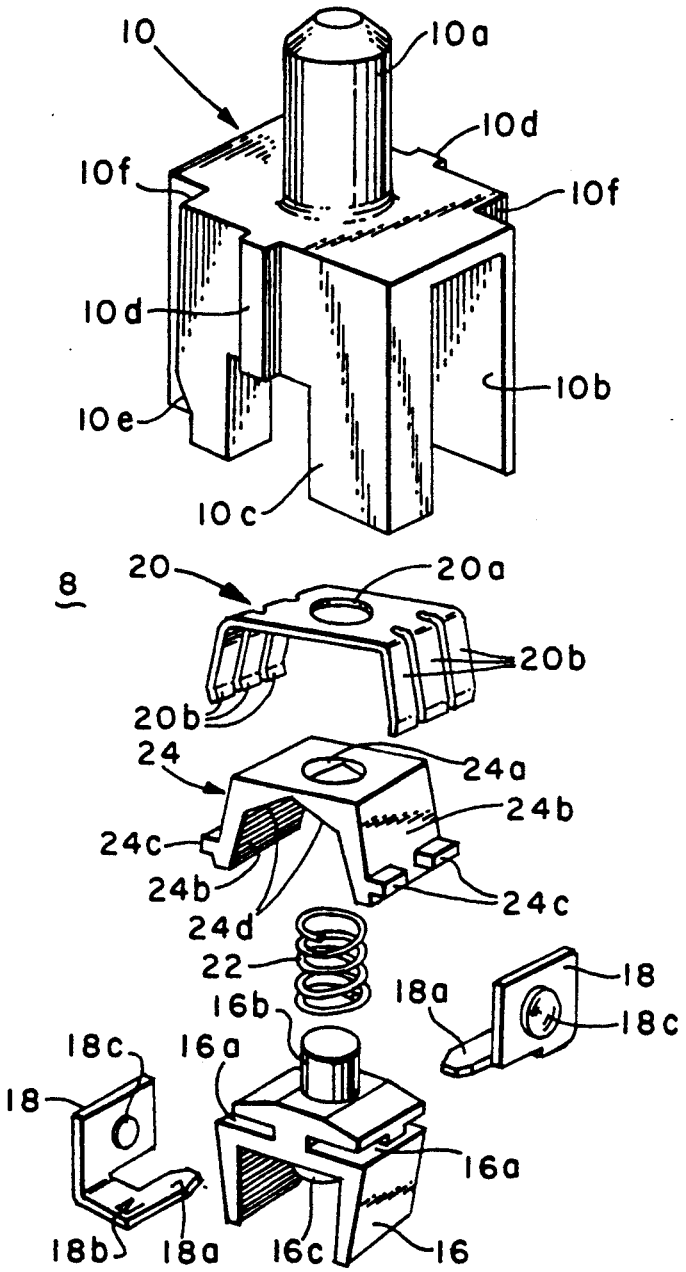
FIG. 4 is an exploded perspective view of elements comprising a plunger operator assembly of the electric switch of this invention.

A plunger operator assembly 8 is guided for reciprocal movement in the cavity 4f between an extended position and a depressed position. The plunger operator assembly 8 is best seen in FIGS. 3 and 4. It comprises a movable contact carrier 16 molded of insulating material having a pair of slots 16a extending along lateral edges thereof. Tongue portions 18a of a pair of primary movable contacts 18 are inserted into the slots 16a. The tongue portions 18a have a sheared projection as seen at 18b (FIG. 4) which is offset to the lower surface of the tongue portion 18a to grip the insulating material of the carrier 16, locking the movable contact 18 to the carrier 16. The primary movable contacts 18 are L-shaped members having contact buttons 18c riveted to the upright leg of each member.

Plunger operator assembly 8 also comprises a pushbutton operator 10 which has a pushbutton stem 10a extending upwardly through the hole 4d in housing 4. Pushbutton operator 10 is a molded plastic member having a channel 10b open to the bottom of the member and extending lengthwise therethrough. A second channel 10c extends transversely through operator 10 at a shallower depth, the channels defining four legs located at the respective corners of the member for guiding the pushbutton operator 10 for linear reciprocal movement within the cavity 4f. A pair of lateral ribs 10d are located on opposite sides of pushbutton operator 10 to be received in slots (not shown) in interior surfaces of the cavities 4f of the respective housing shell halves 4a and 4b to provide additional guiding for linear reciprocal movement of pushbutton operator 10 within housing 4. Pushbutton operator 10 is symmetrical about a vertical center line extending through the pushbutton stem 10a and has identical cam structures 10e formed at one pair of diagonally opposite corners, only one of which is clearly visible in FIG. 4. Cam structure 10e is an angular surface formed on a relieved surface 10f at the respective corner of the pushbutton operator member 10. A cylindrical boss 10g (FIG. 3) depends from the bottom of the pushbutton member 10 within the channel 10b as seen best in FIG. 3. Depending boss 10g aligns coaxially with an upstanding cylindrical stem 16b on contact carrier 16 to be in abutting engagement therewith.

A secondary contact 20 is disposed over stem 10g of pushbutton operator member 10 to rest against the underside of the member within the channel 10b as seen in FIG. 3. Contact member 20 is essentially an inverted U-shaped member having a hole 20a in the base and having outer legs slotted to provide trifurcated contact fingers 20b. The fingers 20b are preformed to extend angularly outwardly at greater than a 90° angle and, as seen in FIG. 3, are assembled to bear against the inside surfaces of the respective primary movable contacts 18 to electrically bridge the separate movable contacts 18. The trifurcated fingers 20b accept the different levels of the interior surface of the respective movable contact 18 created by the riveted shank of movable contact button 18c. A helical compression spring 22 is disposed over cylindrical boss 16b and stem 10g to bias the pushbutton operator 10 and secondary bridging contact 20 away from the contact carrier 16 and primary movable contacts 18.

A molded insulating lock member 24 is also provided in the plunger operator assembly 8. Lock 24 is essentially an inverted U-shaped member having a hole 24a through the base thereof to provide a clearance opening for receiving the depending stem 10g of pushbutton operator 10. The outer legs 24b of lock 24 extend slightly angularly outwardly and have outwardly projecting integral blocks 24c disposed near the distal ends thereof. The interior surface of the base of lock 24 comprises an inverted V-shaped cam surface defined by a pair of angular surfaces 24d extending from outer legs 24b and joined together at the center of the member 24 to provide a reduced thickness hinge for the lock member along a transverse center line. Lock member 24 is disposed over the depending stem 10g and is folded slightly along the hinge such that the blocks 24c are disposed below the distal ends of the fingers 20b of secondary contact 20, and against the inner surfaces of primary movable contacts 18 as seen in FIG. 3 wherein lock 24 is shown in elevation for clarity. The upper end of helical compression spring 22 bears against the respective angular surfaces 24d to apply an outward bias to the outer legs of the lock member while at the same time biasing the secondary contact 20 and pushbutton operator 10 upwardly away from the contact carrier 16 and primary movable contacts 18.

The entire plunger operator assembly 8 is biased upwardly against the flanged end of the housing 4 by a plunger return spring 26. The spring 26 seats against a bottom wall of the housing 4 within cavity 4f and against the bottom surface of contact carrier 16, positioned thereon by a semispherical boss 16c formed on the bottom side of the contact carrier 16 and seating within the upper end of spring 26. Plunger return spring 26 is substantially stronger than spring 22 and therefore maintain the plunger assembly 8 in tact wherein secondary contact 20 remains in bridging engagement with primary movable contacts 18 as shown in FIG. 3 by biasing the pushbutton operator 10 of the plunger assembly 8 against the upper wall of the housing. Application of switch operating pressure to pushbutton stem 10a depresses the entire plunger operator assembly 8 downward against the bias of return spring 26, carrying primary movable contact buttons 18c into engagement with stationary contact buttons 14a. As long as the operating force is applied to the pushbutton stem 10a, a circuit is completed through the stationary contacts 14, primary movable contacts 18 and secondary bridging contact 20.

Referring particularly to FIG. 3, a stationary contact 28 is mounted in the housing 4 along the right-hand wall thereof, the contact having a portion 28a extending out the bottom wall of the housing as a terminal. The upper end of contact 28 extends inwardly and has a reversely bent dounwardly extending leg 28b having a contact surface on the interior face thereof. The right-hand movable contact 14 as viewed in FIG. 3 is not identical to the left-hand contact 14 inasmuch as the right-hand contact leaf spring is bifurcated to provide two parallel extending legs, one disposed behind the other as viewed in FIG. 3. The rear leg 14c is bent outwardly at the upper end and has a contact button 14d riveted to the distal end thereof. Leaf spring contact leg 14c is preformed to extend inwardly toward the center line of the plunger assembly and therefor is biased to a normally closed position with stationary contact leg 28b. The bend which originates the outward flare of the distal end of leaf spring contact 14c is disposed in the path of cam surface 10e of pushbutton operator 10. Engagement of cam surface 10e with the outwardly flared distal end of stationary contact 14c upon depression of pushbutton operator 10 cams the rear leg 14c outwardly, separating the riveted contact button 14d from the downwardly turned contact leg 28b. As will be seen in the description of the sequential FIGS. 5, 6 and 7, the normally closed contact set 14d–28b is operated to the open condition upon operation of the switch prior to closing of the primary movable contacts upon the stationary contacts 14a, and is operated to a closed condition subsequent to the opening of the primary movable contacts 18c from the stationary contacts 14a. This arrangement of the contacts 14c and 28 renders then particularly suitable for use as dynamic braking contacts whereby a motor armature A (FIGS. 5–7) may be connected through a dynamic braking resistor R (FIGS. 5–7) to dissipate the counter EMF in the motor and quickly bring the motor to a stop when power is disconnected from the motor.

Figure 5:
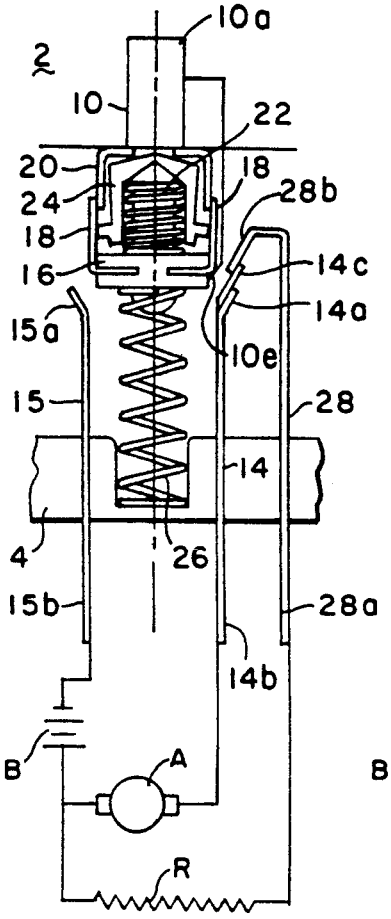
FIG. 5 is a schematic view of the switch of FIGS. 1–4 connected in a motor control circuit and shown in an OFF condition.

Referring to FIG. 5, the switch 2 is shown in schematic form having its terminal 15b of stationary contact 15 connected to a power source such as D.C. battery B. One side of a motor armature A is connected to the battery B while the opposite side of the motor armature A is connected to the terminal 14b of stationary contact 14. A dynamic braking resistor R has one end connected to the point common between the motor armature A and the battery B and the other end connected to the terminal 28a of stationary contact 28. FIG. 5 depicts the switch 2 in the extended position of plunger operator assembly 8 wherein the primary movable contacts 18 are separated from stationary contacts 14a, 15a and the leaf spring contact 14c is closed against stationary contact 28b completing a dynamic braking circuit through resistor R and motor armature A.

Figure 6:
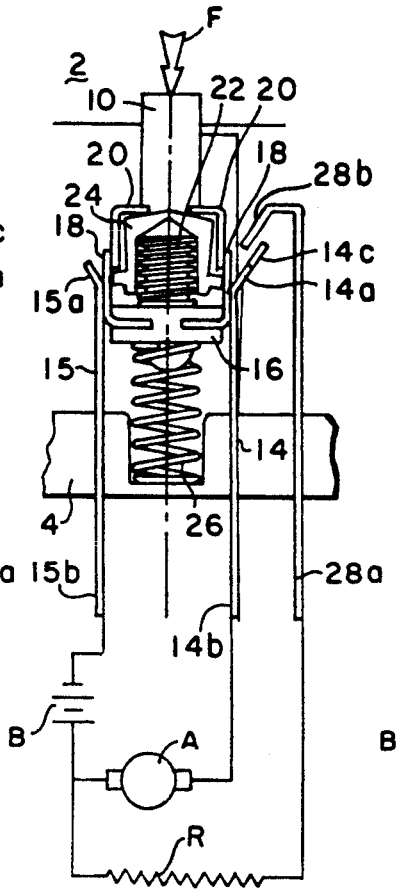
FIG. 6 is a view similar to FIG. 5 showing the switch in an ON condition.
Figure 7:
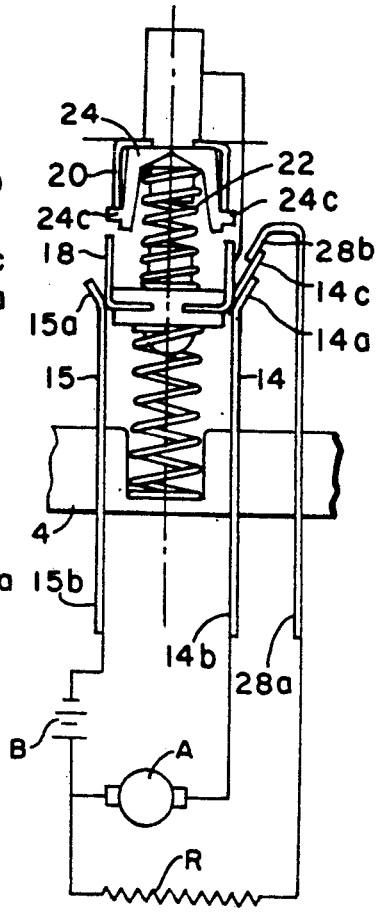
FIG. 7 is a view of like FIGS. 5 and 6, showing the switch in a welded contact condition wherein the secondary contact has been operated to open the circuit controlled by the switch.

FIG. 6 shows the switch 2 operated to a depressed position by application of a force F upon the pushbutton 10a of pushbutton operator 10 to close the primary movable contacts 18 on the stationary contacts 14a, 15a. In the depressed position, the primary movable contacts bridge the stationary contacts through secondary bridging contact 20, thereby connecting motor armature A in series with battery B to energize the motor. Note that the cam surface 10e on pushbutton operator 10 has separated the leaf spring contact 14c from stationary contact 28b is the dynamic braking circuit to disconnect the resistor R from the motor armature A. In FIG. 7, the operating force F has been removed from pushbutton operator 10 to permit the plunger operator assembly 8 to return to the extended position under the bias of return spring 26. However, primary movable contacts 18 have welded to stationary contacts 14a, 15a, arresting the upward movement of the primary movable contacts and contact carrier 16. This permits spring 22 to bias the secondary contact 20, lock 24 and pushbutton operator 10 upwardly away from primary stationary contacts 18, opening the circuit between the movable contacts 18 and opening the circuit to motor armature A. As seen in FIG. 7, spring 22 bears against the cam surfaces 24d of lock 24 to urge the distal ends of the legs outwardly between the upper edges of stationary contact members 18 and the distal ends of trifurcated contact fingers 20b of secondary contact 20, thereby preventing reclosure of the secondary contact 20 upon the stationary contacts 18 upon subsequent depression of the pushbutton operator 10. Thus secondary contact 20 opens the circuit to motor armature A in the event that the primary movable contacts 18 weld to the stationary contacts 14a, 15a. It should be noted in FIG. 7 that the upward movement of pushbutton operator 10 under the influence of spring 22 is sufficient to cause cam surface 10e to move away from the leaf spring contact 14c, permitting it to close upon stationary contact 28b and complete the dynamic braking ciruit through resistor R and motor armature A.

Figure 8:
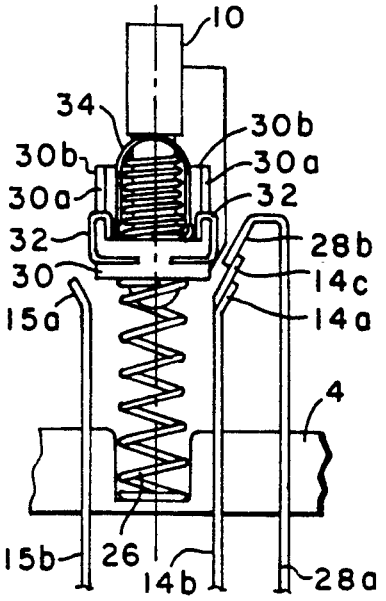
FIGS. 8, 9 and 10 are schematic views similar to FIGS. 5, 6 and 7 (but not showing the control circuit) of an alternate embodiment of the invention.
Figure 9:
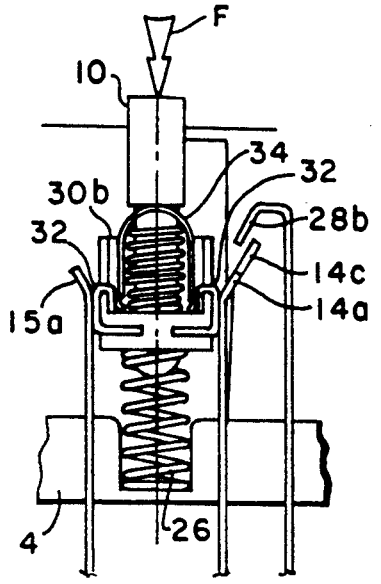
Figure 10:
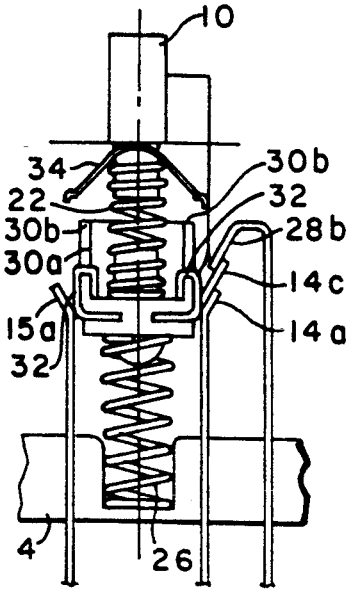

A modified form of the switch of this invention is shown in FIGS. 8–10 which are sequential schematic views similar to FIGS. 5–7. The battery B, motor armature A and dynamic braking resistor R shown in FIGS. 5–7 have been omitted in FIGS. 8–10, but should be considered to be connected in the same manner. Like parts in the two versions have been given the same number. In the embodiments shown in FIGS. 8–10, a movable contact carrier 30 comprises a cup-like member having a pair of opposed slots 30a in side walls 30b to receive a turned down tang the primary movable contact member 32. A leaf spring secondary contact 34 is disposed over the depending stem 10g of pushbutton operator 10 and is deformed to a U-shape whereby the distal ends bear against the turned down tabs of primary movable contacts 32 in bridging relationship therebetween. As seen in FIG. 9, depression of the plunger operator assembly by application of the force F on pushbutton operator 10 moves the plunger assembly to a depressed position against the bias of return spring 26 to cause primary movable contacts 32 to close upon stationary contacts 14 and 15. Removal of the force F permits the plunger assembly to return to the extended position but, as shown in FIG. 10, the primary movable contacts 32 have welded to the stationary contacts 14a and 15a, retaining the contact carrier 30 and primary movable contacts 32 in the partial depressed position. With the removal of the operating force from the operator member 10, spring 22 biases member 10 to its extended position, carrying therewith the secondary contact 34 which moves free of the primary movable contacts 32, opening the circuit therebetween. The secondary contact 34 is prevented from re-engaging with primary movable contacts 32 by engagement of the upper end of the walls 30b with the secondary contact 34, thereby camming the legs of the secondary contact outwardly if pushbutton 10 is subsequently depressed. It is to be noted that the dynamic braking contacts 14c and 28b operate in the same manner as that described in conjunction with FIGS. 5–7.

Figure 13:
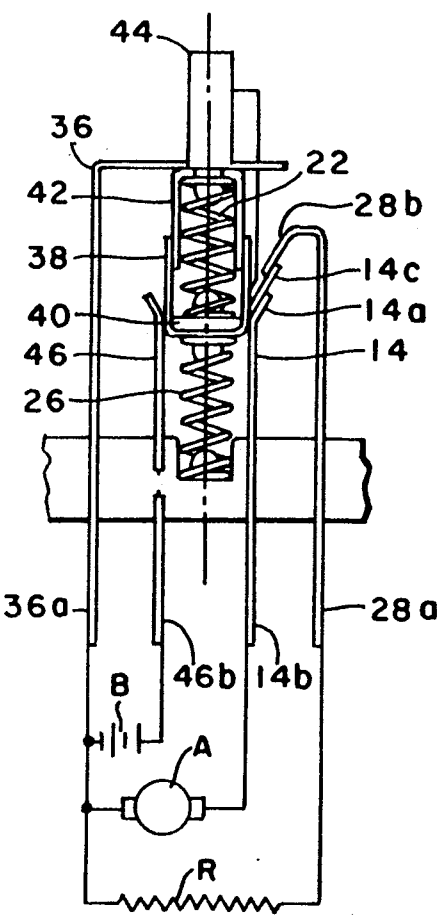
FIGS. 11, 12 and 13 are schematic views like FIGS. 5, 6 and 7, showing an alternate embodiment of the invention.
Figure 12:
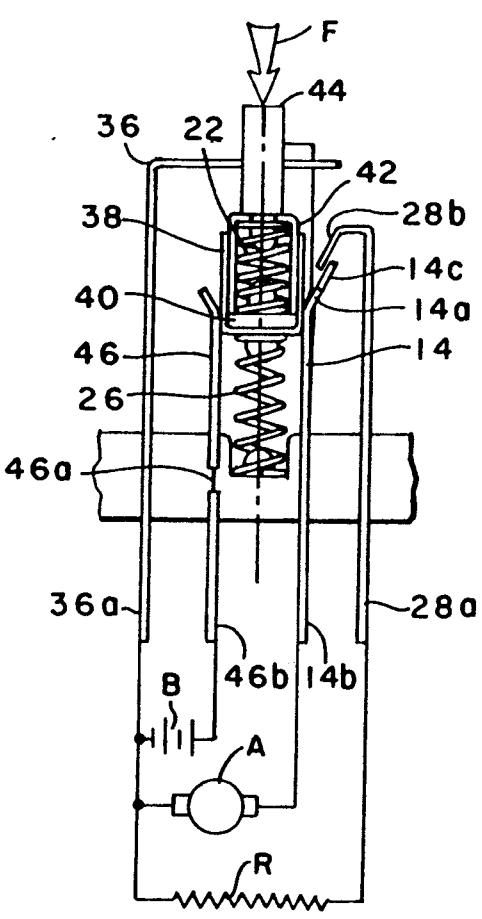
Figure 11:
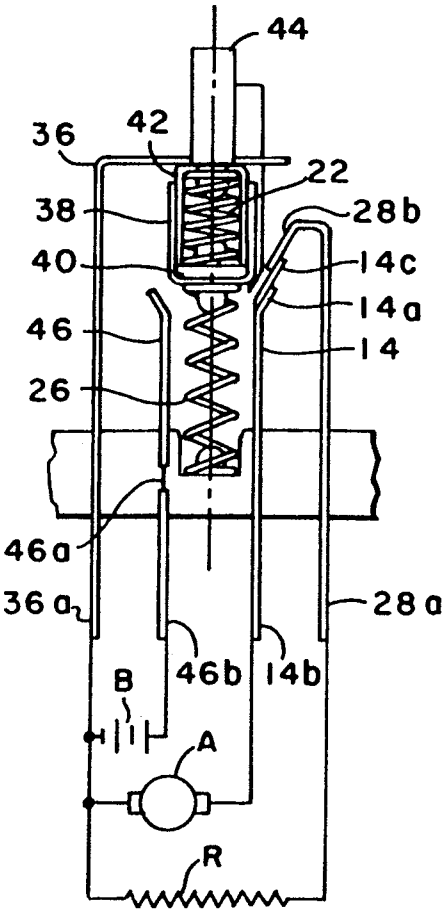

An alternate embodiment of the switch of this invention is shown in FIGS. 11, 12 and 13 which are sequential schematic views similar to FIGS. 5–7. Like parts in the two embodiments have been given the same number. In FIGS. 11–13 an L-shaped secondary stationary contact is provided along one side and across the top of the switch. The primary movable contact is a U-shaped bridging element 38 mounted on a contact carrier 40. A secondary movable contact 42 is mounted for movement with a pushbutton operator 44 and is also a U-shaped element disposed in an inverted position between the legs of bridging contact 38. Secondary movable contact 42 is movable relative to primary movable contact 38 and is electrically conductive therewith by a wiping connection between the respective legs of the two contact elements. Spring 22 is disposed between contact carrier 40 and the center leg of secondary movable contact 42, biasing the contact 42 against the pushbutton operator 44 and biasing the operator 44 away from the contact carrier 40. Spring 26 biases the entire plunger assembly to the extended position as shown in FIG. 11 whereat secondary movable contact 42 abuts secondary stationary contact 36.

A primary stationary contact 46 replaces the left stationary contact 15 in the FIGS. 11–13 embodiment. Stationary contact 46 has a fuse link 46*a* integrally formed therein as a reduced thickness section particularly constructed to destruct upon a predetermined current value in the contact. Right primary stationary contact 14 remains the same as the FIGS. 5–7 embodiment and includes dynamic braking leaf spring contact 14*c* cooperating with stationary contact 28*b*.

Referring to FIG. 11, the switch is connected in a motor control circuit wherein one side of the motor armature A is connected to terminal 14*b* of stationary contact member 14. The other side of armature A is connected to the battery B. A dynamic braking resistor R has one end connected to the point common between motor armature A and the Battery B and the other end connected to the terminal 28*a* of auxiliary stationary contact 28. The battery B is connected across the terminals 46*b* of primary stationary contact 46 and 36*a* of secondary stationary contact 36. FIG. 11 depicts the switch in the extended position of the plunger operator assembly wherein the primary movable contact 38 is separated from primary stationary contacts 46 and 14, and leaf spring contact 14*c* is closed against stationary contact 28*b* completing a dynamic braking circuit through resistor R and motor armature A.

FIG. 12 shows the switch operated to a depressed position by application of force F upon the pushbutton operator 44 to close the primary movable contact 38 upon the primary stationary contacts 14 and 46. This condition separates contacts 14*c* and 28*b* and connects motor armature A in series with battery B to energize the motor. In FIG. 13 operating force F has been removed from pushbutton operator 44 to permit the plunger assembly to return to the extended position under the bias of return spring 26. However, primary movable contact 38 and stationary contacts 14 and 46 have welded, arresting upward movement of the contact carrier 40. Spring 22 biases the pushbutton operator 44 and secondary movable contact 42 away from contact carrier 40, whereby movable contact 42 engages secondary stationary contact 36. This engagement directly connects battery B to fuse link 46*a*, causing the fuse link to destruct and thereby opening the circuit to motor armature A. Upward movement of pushbutton operator 44 also releases leaf spring contact 14*c*, permitting it to close upon stationary contact 28*b* and complete the dynamic braking circuit through resistor R and motor armature A.

The foregoing has described an electric switch having a secondary contact which is operable upon welding of primary contacts to open the circuit in which the primary contacts are connected. The secondary contact of this switch does not require additional terminals or specific interconnection of the switch and controlled elements in order to effect the secondary safety switching operation designed into this switch. Although the switch has been shown in a best mode construction, it is to be understood that it is susceptible of various modifications without departing from the scope of the appended claims.

We claim:

1. An electric switch comprising:

stationary contact means;

a movable switch mechanism comprising movable contact means;

means biasing said movable switch mechanism to a first position, said mechanism being movable to a second position by application of an operating force to said mechanism in opposition to said biasing means;

said movable contact means comprising first contact means engaging said stationary contact means in said second position of said mechanism completing a circuit through said switch, and second contact means normally closed on said first contact means and in said circuit with said first contact means and said stationary contact means; and means effecting separation of said second contact means from said first contact means and opening of said circuit upon welding of said first contact means to said stationary contact means and removal of said operating force from said mechanism.

2. The electric switch defined in claim 1 wherein:

said movable switch mechanism comprises a contact carrier and a switch operator connected to said carrier for movement relative to said carrier;

said first contact means being mounted for movement with said contact carrier;

said second contact means being mounted for movement with said operator; and said means effecting separation of said second contact means from said first contact means comprising a spring interposed said contact carrier and said operator biasing said contact carrier and said operator apart.

3. The electric switch defined in claim 2 wherein said means biasing said movable switch mechanism to said first position is predominant over said spring interposed said contact carrier and said operator to maintain said second contact means closed on said first contact means in said first position and during application of said operating force.

4. The electric switch defined in claim 2 wherein said means effecting separation of said second contact means from said first contact means comprises an electrical non-conductor effective to block re-closure of a separated said second contact means upon said first contact means.

5. The electric switch defined in claim 4 wherein said non-conductor is driven to a position between said first and second contact means by said spring.

6. The electric switch defined in claim 2 comprising a set of dynamic braking contacts normally closed in said first position of said movable switch mechanism, cam means on said operator separating said dynamic braking contacts during movement of said mechanism to said second position, said cam means releasing said dynamic braking contacts for re-closure upon said separation of said second contact means from said first contact means in response to said welding of said first contact means to said stationary contact means.

7. An electric switch comprising:

an insulating housing having an interior chamber and an opening communicating with said chamber;

stationary contacts mounted in said chamber;

a plunger assembly mounted for reciprocal movement in said housing, said plunger assembly comprising a switch operator extending through said opening and a contact carrier mounted for movement relative to said switch operator;

a first spring biasing said plunger assembly to an extended position;

a pair of movable contacts mounted on said contact carrier engagable with respective said stationary contacts upon application of an operating force to said switch operator moving said plunger assembly against the bias of said spring to a depressed position;

a bridging contact mounted for movement with said switch operator and normally engaging said movable contacts in said extended and depressed positions of said plunger assembly; and a second spring interposed said operator and said contact carrier biasing said operator away from said contact carrier toward said extended position, said second spring being effective, upon welding of said movable contacts to said stationary contacts and removal of said operating force from said switch operator, to drive said operator away from said contact carrier and said bridging contact out of engagement with said movable contacts.

8. The electric switch defined in claim 7 wherein said plunger assembly comprises electrical insulating means effective upon separation of said bridging contact and said movable contacts to block re-engagement of said bridging contact and said movable contacts.

9. The electric switch defined in claim 7 wherein said plunger assembly comprises an electrical insulating member disposed for movement with said switch operator and driven between said movable contacts and said bridging contact upon separation of said bridging contact from said movable contacts, thereby blocking re-engagement of said bridging contact and said movable contact.

10. The electric switch defined in claim 9 wherein said electrical insulating member comprises a cam surface engaged by said second spring, said second spring biasing said insulating member to said blocking position.

11. The electric switch defined in claim 7 comprising a set of dynamic braking contacts disposed in said chamber, said dynamic braking contacts being biased to a normally closed condition and separated by cam means on said switch operator when moving said plunger assembly to said depressed position, and releasing said dynamic braking contacts for re-closure when said second spring drives said operator away from said contact carrier and said bridging contact out of engagement with said movable contacts.

12. A method of opening a circuit within an electric switch when primary contacts of the switch weld together comprising the steps of:

providing spaced stationary contacts;

guiding a plunger assembly comprising a contact carrier and a switch operator movable relative to said contact carrier for reciprocal movement in proximity to said stationary contacts;

biasing said plunger assembly to an extended position;

providing spaced movable contacts on said contact carrier as primary contacts engagable with respective said stationary contacts upon operation of said plunger assembly from said extended position to a depressed position;

providing a secondary contact in bridging engagement with said spaced movable contacts;

biasing said switch operator and said secondary contact away from said contact carrier and out of engagement with said spaced movable contacts when the latter fail to separate from said stationary contacts under the bias of said plunger assembly to said extended position.

13. The method of opening a circuit within an electric switch defined in claim 12 further comprising the step of inserting an electrical insulator between said movable contacts and said secondary contact subsequent to separation thereof to prevent reclosure of said secondary contact with said movable contacts.

14. An electric switch comprising:

an insulating housing having an interior chamber and an opening communicating with said chamber;

stationary contacts mounted in said chamber;

a plunger assembly mounted for reciprocal movement in said housing, said plunger assembly comprising a switch operator extending through said opening and a contact carrier mounted for movement relative to said switch operator;

a first spring biasing said plunger assembly to an extended position;

a movable contact mounted on said contact carrier engagable with and bridging said stationary contacts upon application of an operating force to said switch operator moving said plunger assembly against the bias of said spring to a depressed position;

a secondary movable contact mounted for movement with said switch operator, said secondary movable contact having wiping engagement with said movable contact upon movement of said switch operator relative to said contact carrier;

a secondary stationary contact disposed for engagement by said secondary movable contact in said extended position of said plunger assembly, said secondary stationary contact and one of said stationary contacts being connectable to an electrical power supply;

an electric fuse connected to said one of said stationary contacts; and a second spring interposed said operator and said contact carrier biasing said operator away from said contact carrier toward said extended position, said second spring being effective, upon welding of said movable contact to said stationary contacts and removal of said operating force from said switch operator, to drive said operator away from said contact carrier and drive said secondary movable contact into engagement with said secondary stationary contact, rendering said fuse directly connectable across said electrical power supply.

15. The electric switch defined in claim 14 wherein said electric fuse comprises a fuse link integral with said one of said stationary contacts.

16. The electric switch defined in claim 15 wherein said fuse link comprises a section of reduced material in said one of said stationary contacts.

* * * * *